US008181815B2

(12) United States Patent
Moosheimer et al.

(10) Patent No.: US 8,181,815 B2
(45) Date of Patent: May 22, 2012

(54) SHRINK-FILM SEAL AND METHOD FOR SEALING CONTAINERS

(75) Inventors: Ulrich Moosheimer, Hohenkammern (DE); Florian Carl, München (DE)

(73) Assignee: Schreiner Group GmbH & Co. KG, Oberschleissheim (DE)

( * ) Notice: Subject to any disclaimer, the term of this patent is extended or adjusted under 35 U.S.C. 154(b) by 656 days.

(21) Appl. No.: 12/224,926

(22) PCT Filed: Feb. 19, 2007

(86) PCT No.: PCT/EP2007/051559

§ 371 (c)(1), (2), (4) Date: Oct. 27, 2008

(87) PCT Pub. No.: WO2007/104627

PCT Pub. Date: Sep. 20, 2007

(65) Prior Publication Data

US 2009/0120559 A1 May 14, 2009

(30) Foreign Application Priority Data

Mar. 10, 2006 (DE) ..... 10 2006 011 272

(51) Int. Cl.

| | |
|---|---|
| ***B65B 53/02*** | (2006.01) |
| ***B65D 53/00*** | (2006.01) |
| ***B65D 55/02*** | (2006.01) |
| ***B65D 65/00*** | (2006.01) |

(52) U.S. Cl. ..... 220/694; 220/214; 220/257.1; 53/442; 206/497; 426/122

(58) Field of Classification Search ..... 220/214, 220/257.1, 257.2, 694, 720; 53/442; 206/497; 156/86

See application file for complete search history.

(56) References Cited

U.S. PATENT DOCUMENTS

| | | | | |
|---|---|---|---|---|
| 3,967,993 | A | 7/1976 | Isomi | |
| 5,067,612 | A * | 11/1991 | Tsuchiya et al. | 206/497 |
| 5,605,230 | A * | 2/1997 | Marino et al. | 206/534 |
| 6,691,439 | B1 * | 2/2004 | Miyashita et al. | 40/310 |
| 2005/0214491 | A1 * | 9/2005 | Vora | 428/36.9 |

FOREIGN PATENT DOCUMENTS

| | | |
|---|---|---|
| DE | 659 065 | 4/1938 |
| DE | 24 13 542 | 10/1974 |
| DE | 197 50 429 | 5/1999 |
| EP | 0 794 125 | 9/1997 |
| EP | 1 116 667 | 7/2001 |
| FR | 2 222 278 | 10/1974 |
| FR | 2 299 954 | 9/1976 |
| GB | 1 463 531 | 2/1977 |
| JP | 06-270965 | 9/1994 |

OTHER PUBLICATIONS

International Search Report.

* cited by examiner

*Primary Examiner* — Anthony Stashick
*Assistant Examiner* — Madison L Wright
(74) *Attorney, Agent, or Firm* — Collard & Roe, P.C.

(57) ABSTRACT

A shrink-film seal (101, 201, 301, 401) is described having at least one stamped portion (102, 402, 602, 702) which is arranged along the circumference of a container (203, 303) which is to be sealed. The regions which are defined by the stamping lines are designed in such a way that at least one contiguous window is produced by a shrinking process. This achieves a situation where the opening of the sealed container can be immediately detected simply, without aids or expert knowledge and therefore a considerable increase in the product security is ensured. A method is also described for sealing containers with a shrink-film seal (101, 201, 301, 401).

23 Claims, 9 Drawing Sheets

SHRINK-FILM SEAL AND METHOD FOR SEALING CONTAINERS

CROSS REFERENCE TO RELATED APPLICATIONS

Figure 1:
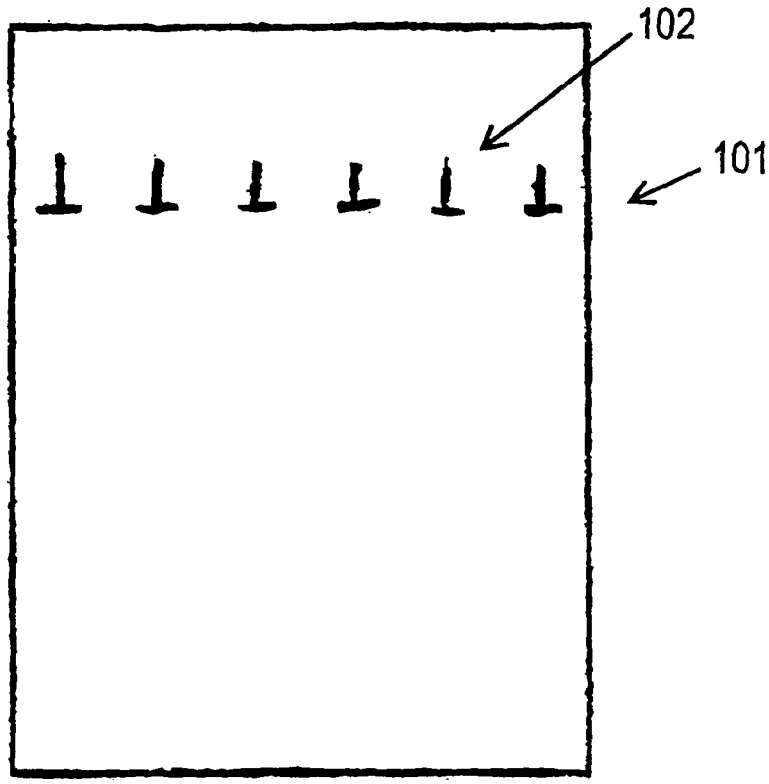

This application is the National Stage of PCT/EP2007/051559 filed on Feb. 19, 2007, which claims priority under 35 U.S.C. §119 of German Application No. 10 2006 011 272.5 filed on Mar. 10, 2006. The international application under PCT article 21(2) was not published in English.

The present invention relates to a film seal in the form of a shrink film. Furthermore, it relates to a method for sealing containers, using such a film seal.

Shrink-film wrappers—also called shrink sleeves—are used in a plurality of applications. For example, they serve to decorate containers such as glass or plastic bottles, or to join multiple containers into a unit, for example in the case of beverage bottles. A third possible function of shrink-film wrappers is that of sealing containers. It is called a film seal when so-called proof of first opening is provided, showing that the container has been opened. Shrink-film seals therefore cover the location at which a container is usually opened, for example the transition between the container and its cap.

Shrinking is understood to be the process of the reduction in expanse of a film, with the goal of applying a shrink tube to a container so that it lies against a container, tightly and usually under tension. In this connection, this can be a process, on the one hand (cold-shrinking) where a film is first stretched, using a suitable tool, and drawn over the container in question, and then elastic stretching is reversed and the film adapts to the outline of the container. On the other hand (in the case of heat-shrinking), a film can be used that greatly contracts under the effect of high temperatures. By heating a shrink film that has been loosely applied to a container, it also comes to lie against the outline of the container. In addition to these two proven shrinking methods, however, other methods of procedure are also possible, for example shrinking processes that are initiated as the result of a chemical effect, or shrinking processes initiated physically in some other way, for example on the basis of the effect of radiation. The form of the shrink-film wrapper, in which it is supplied, is also dependent on the type of shrinking: For the cold-shrinking method, tubular shrink-film wrappers are necessarily used; in the case of the heat-shrinking method, it is additionally possible to make the film available in a flat, non-tubular form: The film is then partially glued onto the container, using adhesives or glues that can be activated, and wrapped around it, usually in such a manner that the second end of the film comes to lie on the film surface in the region of the first end of the film again, and is fixed in place there once again, using adhesives. Shrinking then takes place subsequent to application of the film. In the following, the term shrink-film seal is understood to mean both forms of film seals described, in other words both tubular and flat.

In order to credibly indicate that a container provided with a shrink-film seal has not yet been opened, essentially three aspects have to be guaranteed:

First of all, the shrink-film seal must be applied to the container in such a manner that it is not possible to open the container without destroying the film seal. This is usually guaranteed in that the film seal is shrunk over the edges or over narrowed parts of the container, on both sides, to such an extent that a container cap, for example, cannot be pulled out without damage.

Second of all, the proof of first opening must be irreversible, in order to make it impossible to close the container again without any evidence of that.

Third of all, destruction of the film seal must be clearly evident.

The state of the art offers three technical solution possibilities for this: In a first, simple variant, films for shrink-film seals are selected in such a manner that they tear, in and of themselves, when opening of the container takes place. In a second variant, defined tearing open is achieved by means of weakened areas at a planned breaking point, usually by means of a perforation. The third and most specialized variant is equipping the film with a tear-open thread.

However, the use of tear-open threads is cost-intensive, on the one hand, and on the other hand, arouses associations with the consumer goods industry, and this is not desired by the user, in particular in the case of security-relevant or pharmaceutical areas of application. Similar reservations, primarily esthetic ones, also exist in the case of the first variant, that of a film that tears in and of itself. Perforations, on the other hand, are simple and effective in terms of production, but demonstrate the decisive disadvantage that an opening is often recognized with the naked eye only when it is too late: Straight tearing open along a line is usually very difficult for an inexperienced user to make out.

The present invention is therefore based on the task of making available a shrink-film seal having a tear-open region, in which opening of the sealed container is easily and immediately evident, without aids or technical knowledge, and thus a clear increase in product security is guaranteed. Furthermore, it is the task of the invention to develop a method that enables its user to produce corresponding shrink-film seals, and to seal a container with them, in such a manner that opening of the sealed container is easily and immediately evident, without aids or technical knowledge. Another task consists in making available a corresponding container.

This task is accomplished, according to the present invention, using a shrink-film seal in which a window region is formed by means of shrinking the film onto a container in accordance with the intended purpose, in the region of the punchings. Furthermore, the task is accomplished by means of a method according to another aspect of the invention, which provides for shrinking a shrink-film seal onto a container in such a manner that windows are formed in the region of the punchings of the film seal. Making a corresponding container available is accomplished by means of a container according to further aspect of the invention. Preferred embodiments of the invention are discussed below.

Figure 2:
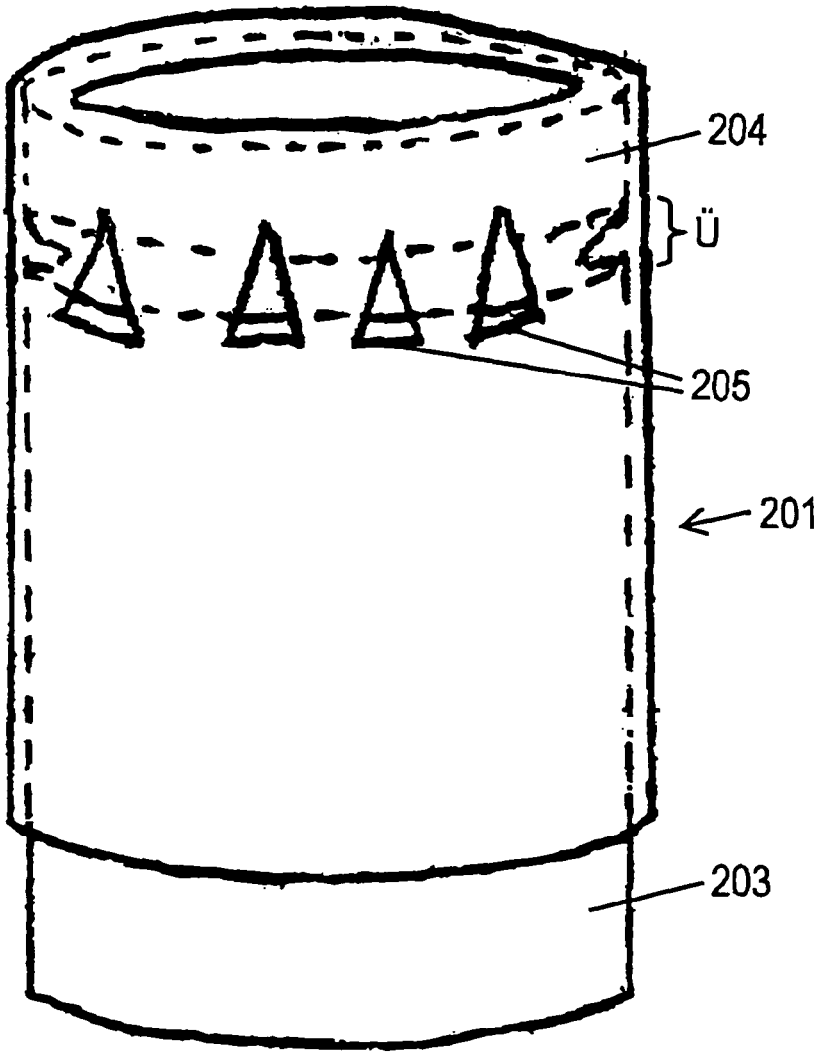
Figure 3:
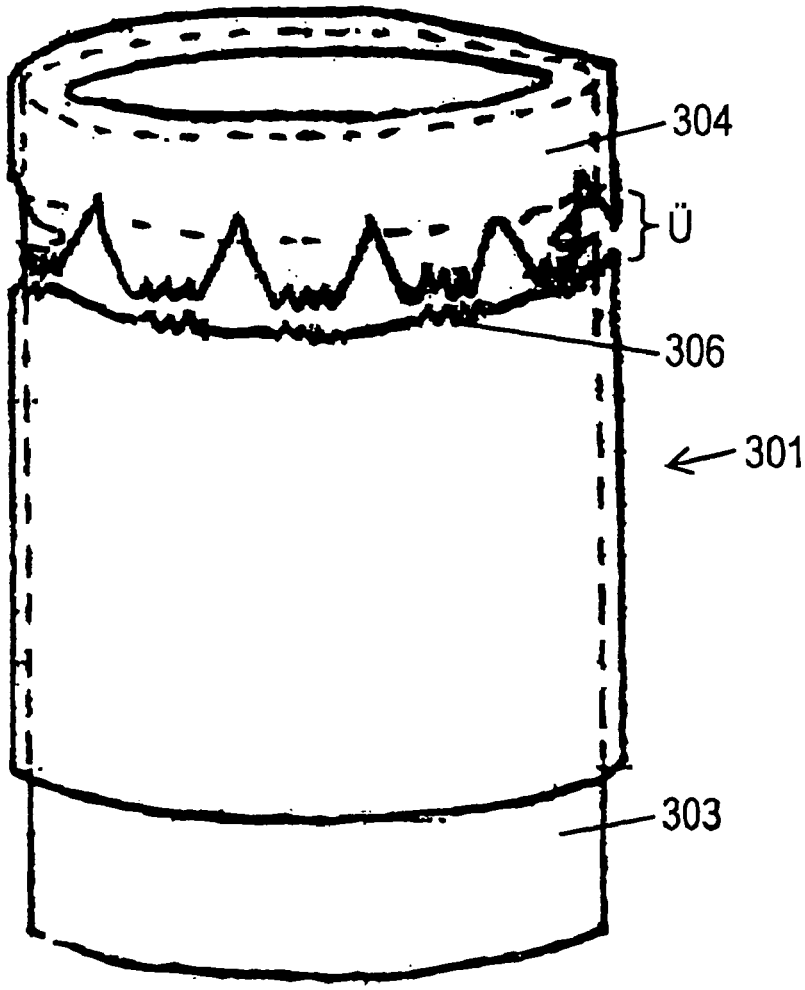
Figure 4:
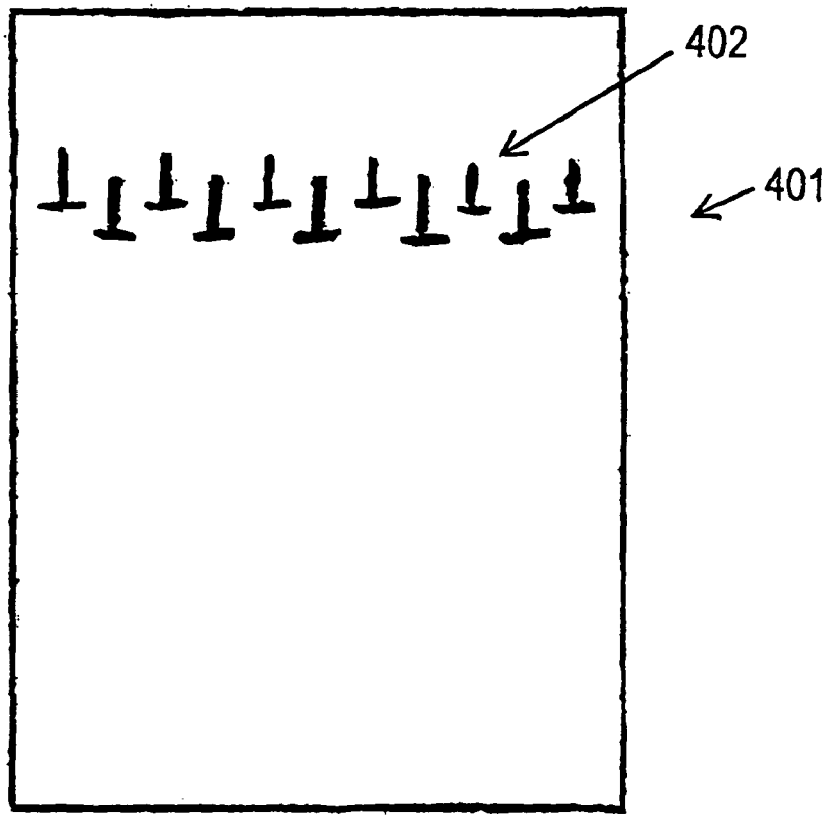
Figure 5A:
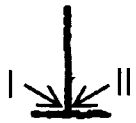
Figure 5B:
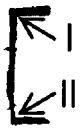
Figure 5C:
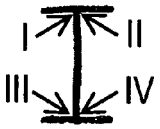
Figure 5D:
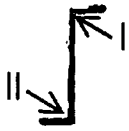
Figure 5E:
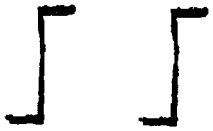
Figure 5F:
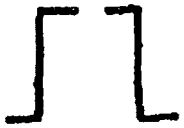
Figure 5G:
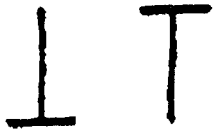
Figure 6A:
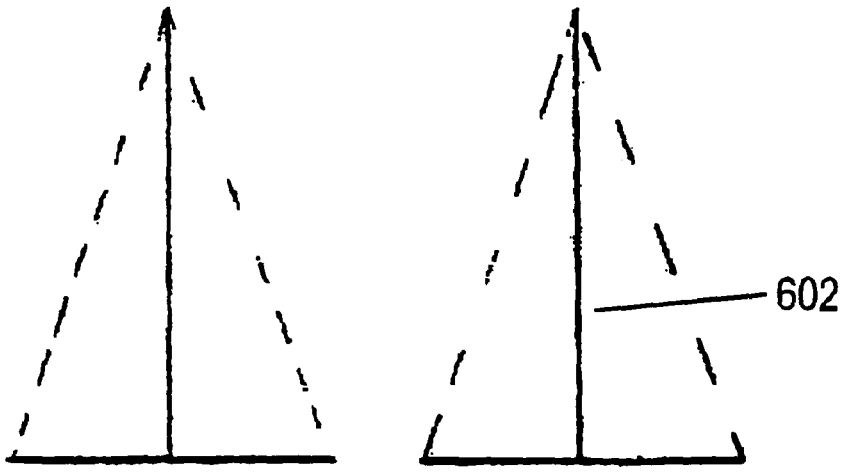
Figure 7A:
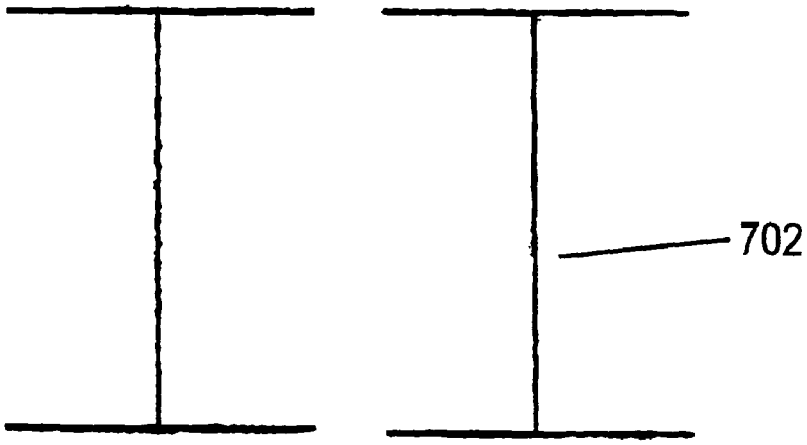
Figure 7B:
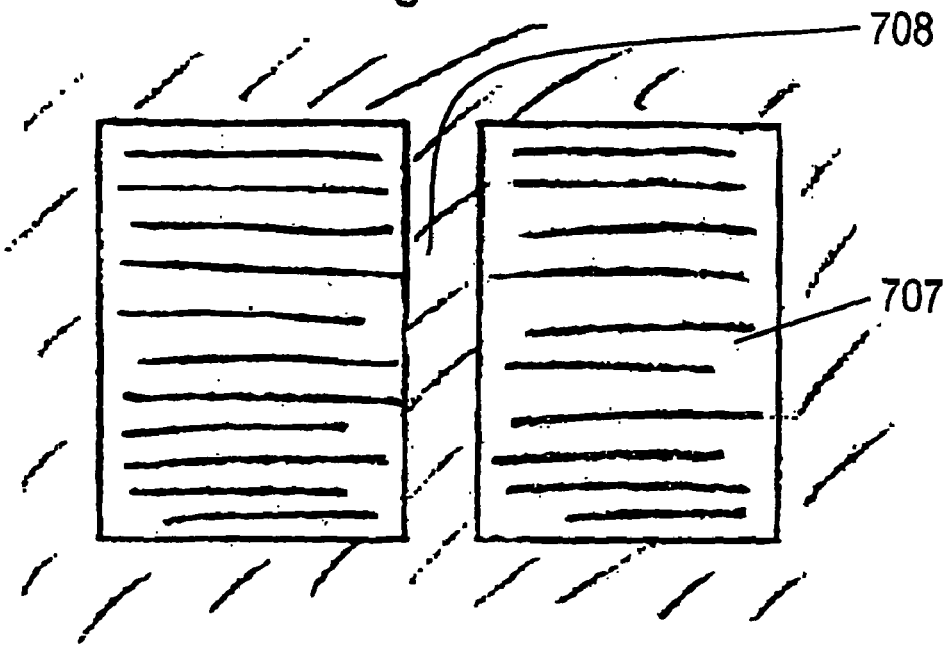
Figure 8:
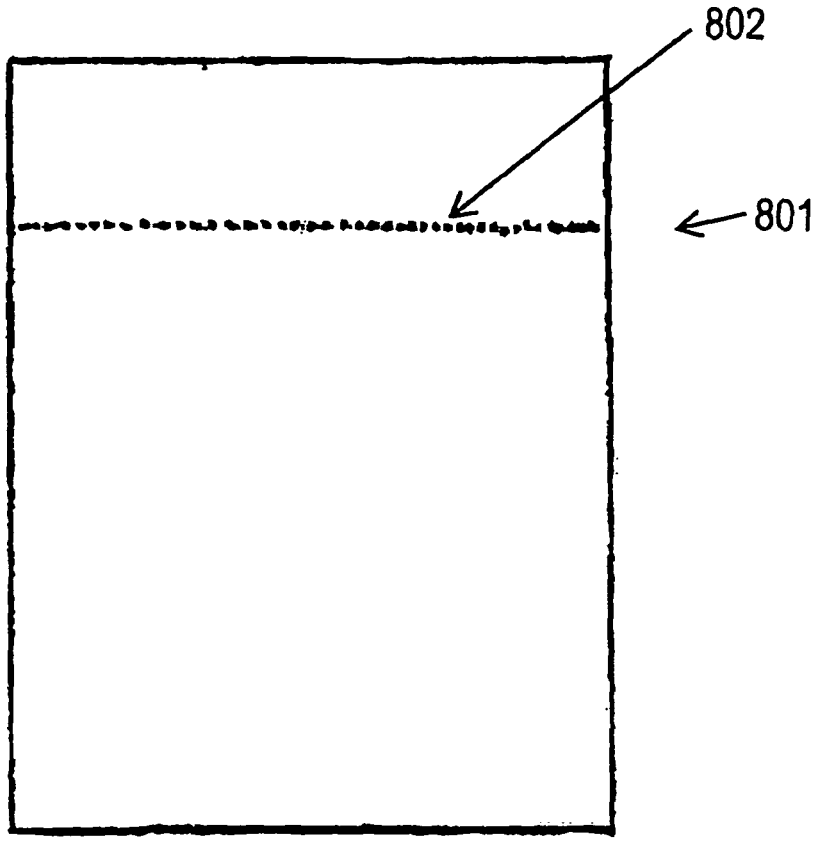
Fig. 8 PRIOR ART
Figure 9:
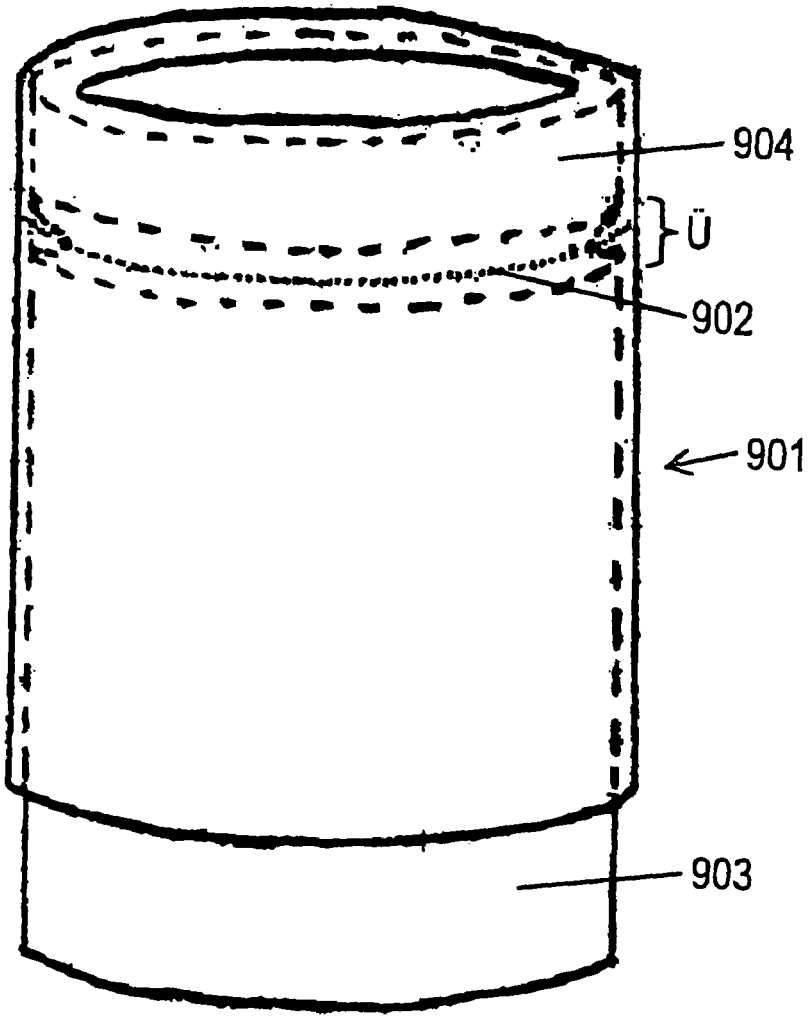
Fig. 9 PRIOR ART

In the following, the invention will be explained in greater detail using FIGS. 1-9, whereby all the drawings are to be understood as being schematic, and in particular, the layer thicknesses are shown with great magnification, for the sake of a better illustration. The figures show:

FIG. 1 a shrink-film seal according to the invention, in a top view,

FIG. 2 a shrink-film seal according to the invention, in the applied state, on a cylindrical container, FIG. 3 a shrink-film seal according to the invention that has been torn open, in the applied state, on a cylindrical container, FIG. 4 a particularly preferred embodiment of the slitting of a shrink-film seal according to the invention, FIG. 5*a*-*g* different punch shapes for the tear-open region of shrink-film seals according to the invention, FIGS. 6*a* and *b* a particularly preferred punch shape before and after shrinking, FIGS. 7*a* and *b* another particularly preferred punch shape before and after shrinking, FIG. 8 a shrink-film seal according to the state of the art, in a top view, FIG. 9 a shrink-film seal according to the state of the art, in the applied state, on a cylindrical container.

FIG. 8 shows a shrink-film seal 801 according to the state of the art, formed from a tubular film and provided with an opening perforation 802.

In FIG. 9, the shrink-film seal 901—numbered analogously—is shrunk onto a container 903. The opening perforation 902 comes to lie over a transition region Ü between the container 903 and the container cap 904 (the outlines are shown with broken lines in the regions that the shrink-film seal covers). It is evident that the upper cap region is also partly covered by the shrink-film seal 901—a result of the shrinking process.

If the container 903 is now opened by removing the container cap 904, the shrink-film seal 901 tears along the opening perforation 902. However, this proof of opening can hardly be seen with the naked eye, so that persons unfamiliar with it can easily assume that the container has not been opened yet.

In contrast, the shrink-film seal 101 shown in FIG. 1 has a special punching 102, here in the shape of an upside-down T. In this connection, at least two punched lines meet, and at least two corners are formed where they meet, preferably at an angle between 60 and 120 degrees.

The effect of this special punching is made clear in FIG. 2: Analogous to FIG. 9, a shrink-film seal 201 according to the invention, of the same type as shown in FIG. 1, is shrunk onto a container 203 having a container cap 204. As a result of the shrinking process, specifically heat-shrinking, windows 205 are now formed in the region of the punchings. This phenomenon is explained by the fact that in the region of the punching, the film is not under tension, as it is in the remaining region of the shrink-film seal, and therefore shrinks away towards the inside, in the direction of the container. For the user, this type of opening region is easily evident right from the start. This effect is further reinforced if the film seal has a color, over the entire area or part of the area, that contrasts with the color of the container 203. Furthermore, the effect is particularly pronounced if a free zone, for example a depression in the container 203 or in the transition region between container 203 and container cap 204, is present underneath the punching. In this way, it is possible that the film, where it is present in freely movable form, without tension, in the region of the punching, can both shrink into itself and fold away towards the back, into the free zone. Therefore, films having a great tendency to shrink, whose length reduction amounts to more than 40%, preferably more than 60%, while they shrink, are particularly preferred. Here, possible materials for heat-shrinking films are primarily polyethylene terephthalate (PET), polyvinyl chloride (PVC), oriented polystyrene (OPS), and polypropylene (PP); polyethylene films are particularly well suited for cold-shrinking methods). In order to make optimal shrinking possible, it is advantageous to use films or film composites having a thickness between 30 and 100 μm, particularly preferably between 50 and 75 μm.

FIG. 3 shows a corresponding container 303 with an opened shrink-film seal 301 and with a container cover or cap 304. In the region of the crosspieces between the windows from FIG. 2, cracks 306 can now be seen, which necessarily form during the opening process. It is not possible to join the edges of these cracks together in unrecognizable manner: The torn-off crosspieces between the windows that have been formed from the special punchings stand out because of the tensions that have occurred, and can therefore be felt immediately, in tactile manner. Furthermore, they are irregular in their shape (indicated by means of spike formation here), since during the course of shrinking, the stresses that occur cause the punched lines to tear a little further.

A particularly preferred form of the special punchings can be seen in the shrink-film seal 401 shown in FIG. 4: Here, the punchings 402 are offset in height, thereby providing even more obvious proof that the seal has been torn open.

Other possible embodiments of special punchings for shrink-film seals, according to the invention, can be seen in FIGS. 5*a-d*, while different arrangements of punch geometries are shown as examples in FIGS. 5*e-g*. All of the embodiments and arrangements have in common the formation of at least two corners (shown as I, II, III, and IV in FIGS. 5*a*-5*d*) by means of punched lines that meet. A corner is formed in that two lines meet one another, and are situated at an angle relative to one another that does not amount to 180 degrees. In the case of a T punch, for example, two corners are already formed in that one line continues past the meeting point of the two lines. To illustrate this, the number of corners was numbered consecutively with Roman numerals I, II, III, or IV in FIGS. 5*a-d*. The corners I, II, III, or IV fundamentally do not have to be pointed, but rather, the definition also covers rounded shapes that continue in a straight line on both sides. By means of the special punch shape, it is guaranteed, in each instance, that a clearly recognizable window region is formed when the film is shrunk on, which region would not be possible in the case of a punched line or in the case of punchings having only one corner, or having different geometrical shapes. This effect is made clear in FIGS. 6*a/b* and 7*a/b*.

By means of the special punch shape, it is guaranteed, in each instance, that a clearly recognizable window region is formed when the film is shrunk on, which region would not be possible in the case of a punched line or in the case of punchings having only one corner, or having different geometrical shapes. This effect is made clear in FIGS. 6*a/b* and 7*a/b*.

Figure 6B:
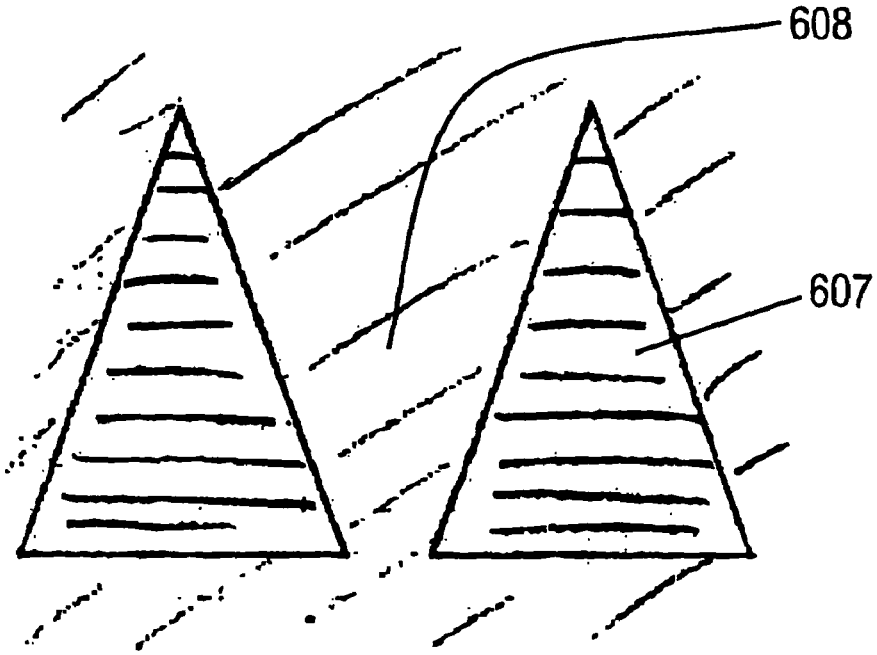

FIG. 6*a* shows two punchings 602 that lie next to one another, in a T shape, a particularly preferred embodiment of the punching. FIG. 6*b* shows the situation after shrinking of the shrink-film seal onto a container. Two windows 607 that lie next to one another (evident from the horizontal cross-hatching) of in the form of equilateral triangles were formed. A crosspiece 608 is situated between them, and is supposed to tear when the container is opened.

FIGS. 7*a* and *b* show another particularly preferred punching geometry, here in the form of a sideways H, analogously numbered as 702 and cross-hatched, which after shrinking form windows 707 with a crosspiece 708 between the windows 707. On the basis of the two pairs of FIGS. 6*a/b* and 7*a/b*, it becomes clear that a plurality of different window shapes can be formed by means of shrinking, by means of selecting the correct punch geometry.

In addition to the characteristics explained here, it is possible to equip the shrink-film seal according to the invention with a number of additional functions, as they are used in the security film sector and in the labeling industry: First of all, in addition to adding color, imprinting with writing, symbols, and similar decorative elements can also take place. Furthermore, additional security elements such as (visible and invisible) security printing methods, holograms, color effects, metal strips, or the like can be used. Non-shrinking film parts on or under the seal label can be used for stabilization, as can additional label components from the pharmaceutical application sector, for example self-adhesive removable evidence labels, information booklets, or suspension devices for infusion stands.

The invention claimed is:

1. Shrink-film seal having at least one punching disposed along a circumference of a container to be sealed, wherein regions defined by punched lines of the at least one punching are configured in such a manner that at least one contiguous window is brought about by a shrinking process, wherein the at least one punching comprises a plurality of punchings disposed at regular intervals comprising a first punching having regions defined by punched lines configured to form a first window and a second punching having regions defined by punched lines configured to form a second window, wherein the regions defined by the punched lines are configured in such a manner that at least one cross-piece is formed between the windows by the shrinking process, and wherein the at least one cross-piece is configured to form a crack with edges which may not be joined together in an unrecognizable manner when the cross-piece is torn off.

2. Shrink-film seal according to claim 1, wherein each punching has at least two corners.

3. Shrink-film seal according to claim 2, wherein each punching has a shape of a T.

4. Shrink-film seal according to claim 2, wherein each punching has a shape of an H.

5. Shrink-film seal according to claim 2, wherein the at least two corners lie at an angle between 60 and 120 degrees.

6. Shrink-film seal according to claim 1, wherein multiple punchings lie in different planes, offset relative to one another.

7. Shrink-film seal according to claim 1, wherein the shrink-film seal is heat-shrinkable.

8. Shrink-film seal according to claim 1, wherein the shrink-film seal is cold-shrinkable.

9. Shrink-film seal according to claim 1, wherein the shrink-film seal comprises a material whose length reduction potential while shrinking amounts to more than 40%.

10. Shrink-film seal according to claim 1, wherein the shrink-film seal contrasts with an intended background in terms of coloring of the shrink-film seal and of the intended background.

11. Shrink-film seal according to claim 1, wherein the shrink-film seal comprises a film comprising a material that can be shrunk onto a container under tension.

12. Method for sealing a container with a shrink-film seal according to claim 1, comprising the following steps:

a) making the shrink-film seal available; and b) shrinking the shrink-film seal onto the container, in such a manner that the at least one contiguous window is formed.

13. Method according to claim 12, wherein the shrinking process is a physically induced process.

14. Method according to claim 13, wherein the shrinking process is a heat-shrinking process.

15. Method according to claim 13, wherein the shrinking process is a process induced via radiation.

16. Method according to claim 12, wherein the shrinking process is a cold-shrinking process.

17. Method according to claim 12, wherein the shrinking process is a chemically induced process.

18. Method according to claim 12, wherein shrinking brings about a length reduction of at least 40%.

19. Method according to claim 12, wherein each punching is brought to lie on a transition region between the container and a container cover before shrinking.

20. Method according to claim 12, wherein each punching is brought to lie on a depression of the container, brought about by a decrease in circumference of the container, before shrinking.

21. Container having a shrink-film seal according to claim 1 shrunk onto the container, wherein an unopened state of the container is indicated by integrity of windows of the shrink-film seal.

22. Container according to claim 21, wherein a film color of the shrink-film seal contrasts with a container color of the container, at least in partial regions.

23. Container according to claim 21, wherein the container comprises a cover and a container body, and wherein a region of the windows lies on a transition region between the container body and the cover, and/or on a depression of the container, the depression having been brought about by a decrease in circumference of the container.

* * * * *